United States Patent [19]

Dürr et al.

[11] Patent Number: 4,592,724

[45] Date of Patent: Jun. 3, 1986

[54] GRATE COOLER AND METHOD OF COOLING

[75] Inventors: Manfred Dürr, Oelde; Georg Unland; Jürgen Würr, both of Ennigerloh; Antonius Vering, Ahlen, all of Fed. Rep. of Germany

[73] Assignee: Krupp Polysius AG, Beckum, Fed. Rep. of Germany

[21] Appl. No.: 617,274

[22] Filed: Jun. 4, 1984

[30] Foreign Application Priority Data

Jun. 20, 1983 [DE] Fed. Rep. of Germany ..... 3322139

[51] Int. Cl.[4] ..... F27D 15/02

[52] U.S. Cl. ..... 432/78; 34/20; 432/134

[58] Field of Search ..... 432/77, 78, 79, 134, 432/2; 34/20, 164

[56] References Cited

U.S. PATENT DOCUMENTS

| | | | |
|---|---|---|---|
| 3,273,255 | 9/1966 | Kramer | 34/20 |
| 3,920,380 | 11/1975 | Heian | 432/78 X |
| 4,147,503 | 4/1979 | Herchenbach et al. | 432/78 |
| 4,367,065 | 1/1983 | Chare | 432/78 X |

*Primary Examiner*—Edward G. Favors

*Attorney, Agent, or Firm*—Learman & McCulloch

[57] ABSTRACT

A grate cooler arranged at right angles to a rotary kiln and having its vertical longitudinal central plane spaced a distance between 10 and 150 cm from the discharge end of the rotary kiln. The zone of the grate cooler lying below the material discharge end of the rotary kiln has more stationary grating plates and more unventilated grating plates per unit area than the laterally adjacent zones of the material receiving end and in the remaining region of the cooler. This results in good protection of the grating plates at the material receiving end and an even distribution of the material over the whole width of the cooler by means of a distribution cone which is kept in motion.

9 Claims, 7 Drawing Figures

GRATE COOLER AND METHOD OF COOLING

BACKGROUND OF THE INVENTION

This invention relates to a grate cooler and method for cooling material discharged from a rotary kiln.

A grate cooler arranged at right angles to a rotary kiln is known and disclosed in German Specification No. C-618 251. The material discharged from the rotary kiln falls onto a connecting chute by means of which it is passed to the material delivery end of the cooler which is constructed as a travelling grate.

This construction has a number of disadvantages, among which are the comparatively great overall height of the whole arrangement, the wear on the connecting chute which is subject to high thermal stress caused by the hot material, and the poor distribution of the material over the whole width of the travelling grate cooler.

The object of the invention, therefore, is to provide a grate cooler of the type referred to which is of more simple and compact construction and which ensures an even distribution of the material discharged from the rotary kiln onto the grate cooler.

SUMMARY OF THE INVENTION

Since the discharge end of a conventional rotary kiln extends almost as far as the vertical longitudinal central plane of the associated thrust grating cooler which normally is arranged at right angles to the rotary kiln, the material discharged from the rotary kiln conventionally is dropped approximately onto the central region of the material receiving end of the cooler. Material discharged to the receiving end forms a distribution cone which on the one hand protects the grating plates at the material receiving end of the cooler from mechanical and thermal damage caused by the hot material discharged from the rotary kiln and on the other hand ensures that the material striking the distribution cone runs off reliably towards the opposite long sides of the thrust grating cooler.

In exhaustive tests on which the invention is based it was shown that the zone of the thrust grating cooler lying below the material discharge region of the rotary kiln must for this purpose have more stationary grating plates and more unventilated grating plates per unit area than the laterally adjacent zones of the material receiving end and the other regions of the cooler. On the other hand, it is necessary for some movable grating plates to be provided below the material discharge region of the rotary kiln in order to prevent the build-up of a heap of clinker which frits together and becomes continually higher (so-called snowman). The percentage increase in the number of unventilated grating plates below the material discharge region of the rotary kiln assists the formation of the material distribution cone and thus the formation and maintenance of inclined distribution surfaces which guide the newly arriving material to the laterally adjacent zones of the material receiving end and to the next region of the cooler in the longitudinal direction.

The preferred relative arrangement of the rotary kiln and the thrust grating cooler and the construction of the grating plates below the material discharge region of the rotary kiln provides both a good protection of the grating plates at the material receiving end and a reliable and even distribution of the material over the whole width of the grate cooler.

In the construction according to the invention there are also some movable grating plates and optionally some ventilated grating plates in the zone of the thrust grating cooler lying below the material discharge region of the rotary kiln (the zone over which the material distribution cone forms) and therefore the distribution cone as a whole is kept in gentle motion. This is of importance because the rotary kiln in general carries out a slow movement to and fro in the longitudinal direction of the kiln so that the point at which the material is dropped alters correspondingly at right angles to the longitudinal direction of the thrust grating cooler. As a result of the formation of the distribution cone which is kept in gentle motion the required even distribution of the material over the width or breadth of the thrust grating is ensured in spite of the fact that the material drop zone of the rotary kiln moves at right angles to the thrust grating cooler.

THE DRAWINGS

Advantageous embodiments of the invention are disclosed in the following description and in the accompanying drawings, wherein.

DETAILED DESCRIPTION

Figure 1:
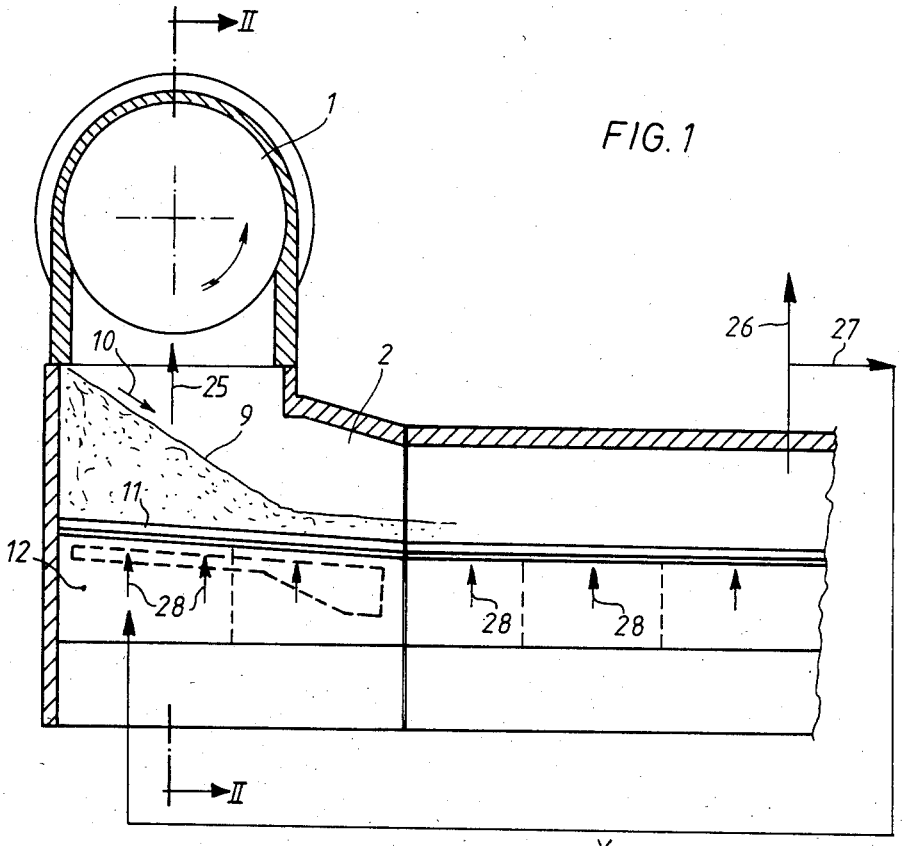
FIG. 1 is a schematic longitudinal section through a thrust grating cooler according to the invention with a rotary kiln arranged at right angles thereto.
Figure 2:
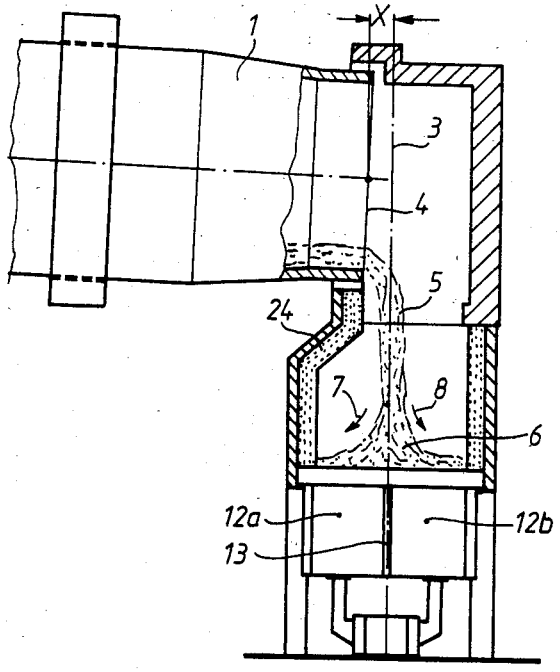
FIG. 2 is a section along the line II—II in FIG. 1.

The plant apparatus illustrated in FIGS. 1 and 2 includes a rotary kiln 1 and a thrust grating cooler 2 which is arranged at right angles to the rotary kiln 1.

As can be seen in particular from FIG. 2, the material receiving end of the thrust grating cooler 2 is arranged immediately below the discharge end of the rotary kiln 1 and the vertical longitudinal central plane 3 of the cooler 2 is a clear distance x from the discharge end 4 of the rotary kiln 1, this distance being between 10 and 150 cm, and preferably between 15 and 50 cm, depending upon the breadth of the thrust grating cooler.

The material 5 discharged from the rotary kiln 1 falls onto the zone of the thrust grating cooler 2 lying below the material discharge region of the rotary kiln and there forms a distribution cone 6 from which the material runs in the direction of the arrows 7 and 8 to the laterally adjacent zones of the material receiving end of the cooler 2.

Furthermore, an inclined surface 9 (FIG. 1) forms in the longitudinal direction of the thrust grating cooler 2 and the newly arriving material has a tendency to move along this surface in the direction of the arrow 10. As a result of this three-way inclination of the distribution cone 6 (to both sides and in the longitudinal direction) the newly arriving material is thus evenly distributed over the whole breadth of the cooler 2.

A number of air chambers 12 which serve to supply cooling air are arranged below the grating 11 of the thrust grating cooler 2. The air chambers provided below the material delivery end of the cooler 2 are divided by partitions (e.g. 13) running parallel to the longitudinal direction of the cooler into at least two partial chambers (e.g. 12*a*, 12*b*) which can be supplied separately with cooling air. In this way it is possible to adapt the ventilation appropriately if the height of the layer and the grain size distribution differ on both sides of the cooler.

Figure 3:
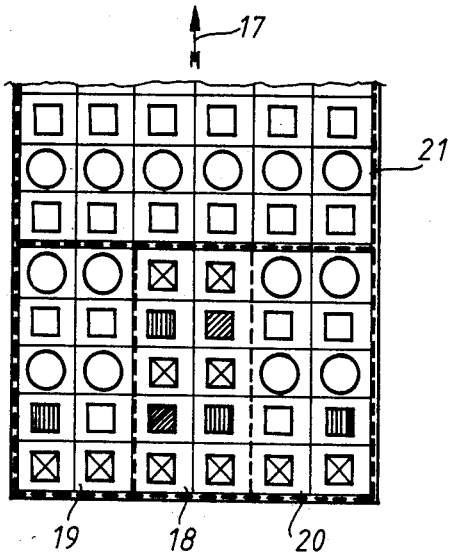
FIGS. 3 and 4 are two schematic plan views of two variants of the material receiving end of the cooler.
Figure 7:
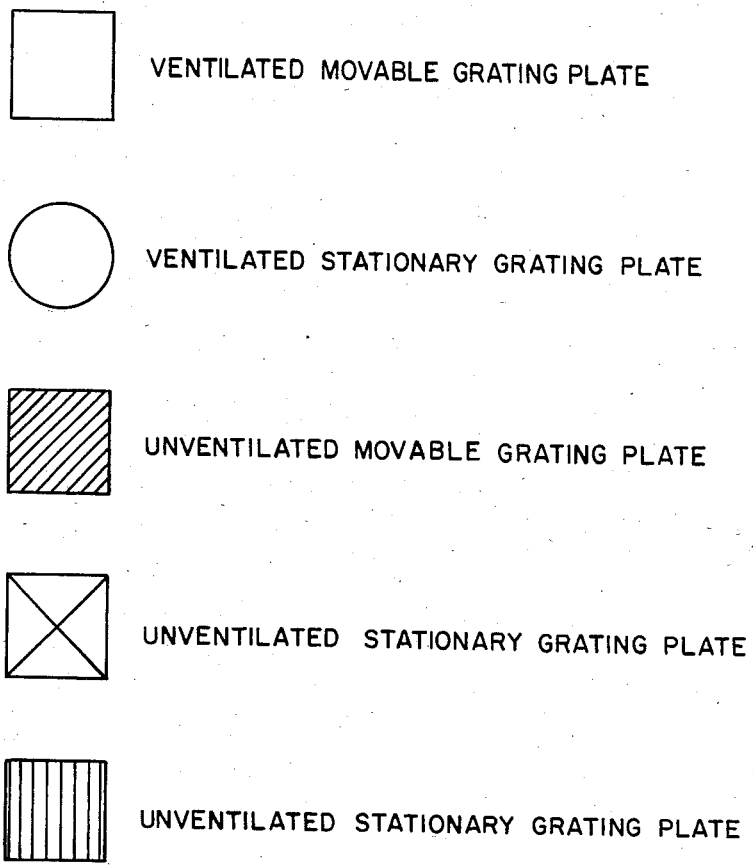
FIG. 7 is a chart indicating the meaning of symbols used in other figures.

FIG. 3 shows an embodiment of the construction of the grating plates of the thrust grating cooler 2 in the region of the material receiving end. In this figure the symbols shown in FIG. 7 designate the respective types of grating plates.

Figure 5:
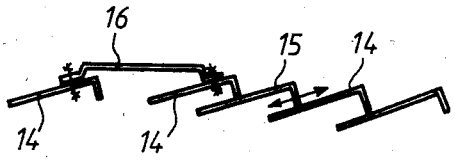
FIG. 5 is a schematic representation of different grating plates.

To facilitate understanding reference is also made to FIG. 5 in which several stationary grating plates 14, a movable grating plate 15 and a stationary bridging plate 16 are shown schematically.

In FIG. 3 the arrow 17 designates the transport direction of the thrust grating cooler. The zone of the material receiving end of the cooler lying below the material discharge region of the rotary kiln is designated by 18, the two laterally adjacent zones by 19 and 20 and the remaining region of the grating downstream is designated by 21.

A total of ten grating plates are provided in the zone 18, and of these eight grating plates (80%) are stationary and all are unventilated.

By contrast, in each of the zones 19 and 20 are ten grating plates, seven (70%) of which are stationary and three of which (30%) are movable. Of the seven stationary plates four are ventilated and of the three movable plates all are ventilated.

In the zone 18 over which the desired material distribution cone is formed, there are more stationary grating plates and more unventilated grating plates per unit area than in the laterally adjacent zones 19, 20 and in the remaining region of the cooler.

In the further embodiment shown in FIG. 4, of a total of eighteen grating plates in the central zone 18' (below the material discharge region of the rotary kiln) 14 grating plates (78%) are stationary and 16 grating plates (89%) are unventilated. By contrast, in the laterally adjacent zones 19', 20' of the material delivery end of the grate cooler, with 36 plates each, 26 plates (72%) are stationary and 15 grating plates (42%) are unventilated.

Figure 4:
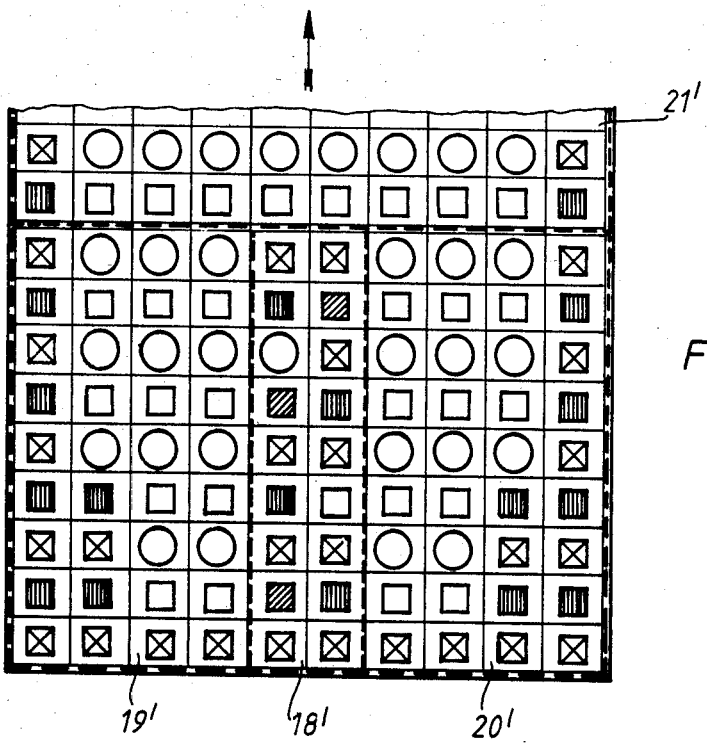

FIGS. 3 and 4 are merely illustrative of possible grating plate arrangements at the material delivery end of the grate cooler 2. Depending upon the prevailing circumstances, in particular the breadth of the cooler, the length of the material receiving end, the height of the material drop, the type of material etc., numerous plate arrangements are possible within the scope of the invention. However, it is essential on the one hand that, in the central zone lying below the material discharge region of the rotary kiln, there are more stationary grating plates and more unventilated grating plates than in the laterally adjacent zones and in the remaining region of the cooler (so that the desired distribution cone builds up), and on the other hand by arrangement of a certain number of movable and possibly ventilated grating plates a sufficient movement of this distribution cone is achieved in order to produce an even distribution and prevent the snowman effect.

As can be seen from FIG. 1, the material receiving end of the cooler 2 can have a somewhat greater inclination in the longitudinal direction than the remaining region of the cooler 2. In this way the flow of the material in the direction of the arrow 10 (in the longitudinal direction of the cooler) is favoured.

Figure 6:
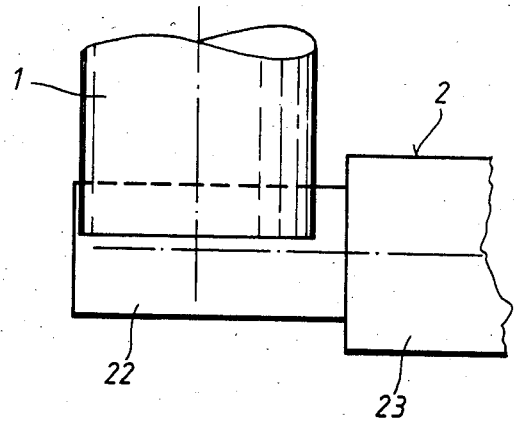
FIG. 6 is a schematic plan view of an embodiment with differing grating width.

It can also be advantageous for the material receiving end 22 (FIG. 6) of the thrust grating cooler 2 to be given a smaller breadth than the remaining region 23 of the cooler in order to favour the distribution of the material on the material receiving end 22.

In order to protect the rotary kiln 1 from excessive thermal stress caused by radiation and hot air, the cover 24 of the cooler is advantageously deflected inwardly at an angle to underlie the lower surface of the discharge end of the rotary kiln 1.

Finally, FIG. 1 also shows an advantageous air circulation for the operation of the grate cooler according to the invention. A proportion of the cooling air extracted from the thrust grating cooler 2 is delivered as usual to the rotary kiln 1 as secondary air (arrow 25), whilst a further proportion flows out of the kiln as exhaust air (arrow 26). According to the invention a proportion of this exhaust air can be returned to the material receiving end of the cooler 2 in the form of recirculated air (arrow 27) in order to achieve fluidisation of the material in the region of the ventilated grating plates. In addition to this recirculated air (27) the grate cooler 2 receives fresh air (arrow 28) in the usual way.

It can also be advantageous for the cooling air delivered to the cooler (fresh air and/or recirculated air) to be caused to pulsate by pulsators (for example rotating flaps) in known manner so that the distribution of the material can be improved over the breadth of the thrust grating cooler.

What is claimed is:

1. A grate cooler adapted to receive material from the discharge end of a rotary kiln arranged at right angles to such cooler, said cooler comprising an elongate thrust grating having a material receiving end below said kiln for receiving material discharged from said kiln, said grating having a vertical plane passing through the longitudinal axis of said grating and spaced from the discharge end of said kiln a distance of between about 10 and 150 cm, said material receiving end having its width divided into a central zone flanked by two lateral zones, said central zone provided with a greater number of stationary grating plates and a greater number of unventilated grating plates than are provided on the lateral zones.

2. A cooler according to claim 1 wherein said distance is between about 15 and 50 cm.

3. A cooler according to claim 1 including at least one air chamber below said grating for supplying cooling air to said material receiving end of said grating, said chamber being divided by a partition extending longitudinally of said cooler.

4. A cooler according to claim 1 wherein the width of said material receiving end of said grating is less than the width of said grating elsewhere.

5. A cooler according to claim 1 wherein said grating is inclined longitudinally of said cooler and in the direction of movement of material along said grating.

6. A cooler according to claim 5 wherein said receiving end of said grating has a greater inclination than the remainder of said grating.

7. A cooler according to claim 1 wherein said cooler has a cover that is deflected inwardly of said cooler below the discharge end of said kiln.

8. A method of cooling material discharged from a rotary kiln to an elongate cooler arranged at right angles to said kiln and provided with a grating having a material receiving zone beneath the discharge end of said kiln, the grating of said material receiving end having at least some ventilated grate plates, said method comprising causing cooling air to pass through the ventilated grate plates, delivering a first proportion of air passed through said ventilated grate plates to said kiln as secondary air, exhausting a second proportion of air passed through said ventilated grate plates from said cooler, and recirculating the exhausted proportion of air through said ventilated grate plates.

9. The method according to claim 8 including causing air passing through said ventilated grate plates to pulsate.

* * * * *